US008784128B2

(12) United States Patent
Cawood et al.

(10) Patent No.: US 8,784,128 B2
(45) Date of Patent: Jul. 22, 2014

(54) INSULATION PIERCING CONNECTOR HOUSING

(71) Applicant: Thomas & Betts International, Inc., Wilmington, DE (US)

(72) Inventors: Matthew D. Cawood, Deleon Springs, FL (US); James L. Zahnen, Ormond Beach, FL (US); Ronald A. Vallette, Ormond Beach, FL (US)

( * ) Notice: Subject to any disclaimer, the term of this patent is extended or adjusted under 35 U.S.C. 154(b) by 0 days.

(21) Appl. No.: 13/742,634

(22) Filed: Jan. 16, 2013

(65) Prior Publication Data

US 2013/0183874 A1 Jul. 18, 2013

Related U.S. Application Data

(60) Provisional application No. 61/587,760, filed on Jan. 18, 2012.

(51) Int. Cl.
*H01R 11/20* (2006.01)

(52) U.S. Cl.
USPC ..... 439/395; 439/431; 439/521

(58) Field of Classification Search
USPC ..... 439/395, 431–433, 801, 806, 519, 521, 439/892
See application file for complete search history.

(56) References Cited

U.S. PATENT DOCUMENTS

| | | | | |
|---|---|---|---|---|
| 3,183,302 | A | 5/1965 | Wochner et al. | |
| 4,643,512 | A | 2/1987 | Prodel | |
| 4,964,813 | A | 10/1990 | Francois et al. | |
| 4,985,003 | A | 1/1991 | Francois et al. | |
| 5,302,144 | A | 4/1994 | Francois et al. | |
| 6,201,184 | B1 | 3/2001 | Francois et al. | |
| 7,090,544 | B2 * | 8/2006 | Campbell et al. | 439/810 |
| 2010/0003846 | A1 * | 1/2010 | Diniz et al. | 439/395 |

OTHER PUBLICATIONS

Canadian Office Action dated Feb. 28, 2014, issued by the Canadian Intellectual Property Office in corresponding Canadian Application 2,802,701, 3 pages.

* cited by examiner

*Primary Examiner* — Khiem Nguyen
(74) *Attorney, Agent, or Firm* — Snyder, Clark, Lesch & Chung, LLP

(57) ABSTRACT

A housing for retaining an insulation piercing connector (IPC) includes an upper housing, a lower housing, and a hinge. The lower housing includes a cavity formed therein. The hinge is coupled to the upper housing and the lower housing to permit movement of the upper housing and the lower housing into open and closed configurations. When in the closed configuration, the upper housing is aligned with the lower housing. The second cavity is configured to received\ the IPC. The lower housing includes an aperture formed transversely therethrough for receiving a cable extending from the IPC upon receipt of the IPC into the second cavity.

20 Claims, 6 Drawing Sheets

INSULATION PIERCING CONNECTOR HOUSING

RELATED APPLICATION

This application claims priority under 35 U.S.C. §119 based on U.S. Provisional Patent Application No. 61/587,760 filed Jan. 18, 2012, the disclosure of which is incorporated by reference herein in its entirety.

BACKGROUND INFORMATION

Typically, power is distributed from an insulated overhead cable either by stripping a section of the cable and using a conventional connector, or alternatively, by using an insulation piercing connector (IPC). An IPC makes an electrical contact with the cable when a conducting portion of the IPC pierces the insulation of the cable. Power is drawn from the cable via a tap that is attached to the IPC.

A typical IPC provides for a single tap. This can be a disadvantage in a crowded urban environment where multiple taps are needed to supply power to multiple dwelling units.

BRIEF DESCRIPTION OF THE DRAWINGS

The accompanying drawings, which are incorporated in and constitute a part of this specification, illustrate one or more embodiments described herein and, together with the description, explain the embodiments. In the drawings.

DETAILED DESCRIPTION OF PREFERRED EMBODIMENTS

The following detailed description refers to the accompanying drawings. The same reference numbers in different drawings may identify the same or similar elements.

As described herein, an insulation piercing connector (IPC) housing insulates an IPC that may be used with a single duplex or triplex cable. The IPC housing prevents shorts and protects installers. In addition, the IPC housing includes a feature that may be used with a serialized utility lock to secure the housing. The feature and the lock may prevent unauthorized opening of the IPC housing, tapping the IPC within the IPC housing, and stealing power from the IPC.

FIGS. 1A, 2A, 2B, 4A, 4B, and 4C are an isometric perspective top view, a bottom view, a top view, a side view, a rear view, and a front view, respectively, of an exemplary IPC housing 100 in a closed configuration. IPC housing 100 may contain an IPC (shown at 160 in FIG. 1C) that is coupled to a cable (not shown). In some implementations, for example, the cable may include an overhead power line that is suspended via towers or utility poles. When the IPC is attached to the power line, the IPC and IPC housing 100 may be located/positioned at some distance (e.g., 2-8 feet) away from the body of the tower/pole. As shown in FIGS. 1A and 4A-4C, IPC housing 100 may include upper cover 102 and lower cover 104. Upper cover 102 and lower cover 104 may be coupled together via hinge 120. IPC housing 100 may be made of different types of material, such as a plastic molding (e.g., thermo plastic (e.g., polyethylene), rubber, etc. that may protect an installer of the IPC/IPC housing 100 and prevent wires/cables attached to the IPC from shorting.

FIGS. 1B, 3A, 3B, 5A, 5B, and 5C are an isometric perspective top view, a top view, a bottom view, a side view, a rear view, and a front view, respectively, of IPC housing 100 in an open configuration. As shown, IPC housing 100 is initially empty prior to insertion of an IPC. Top cover 102 and bottom cover 104 provide space for containing the IPC.

Figure 1A:
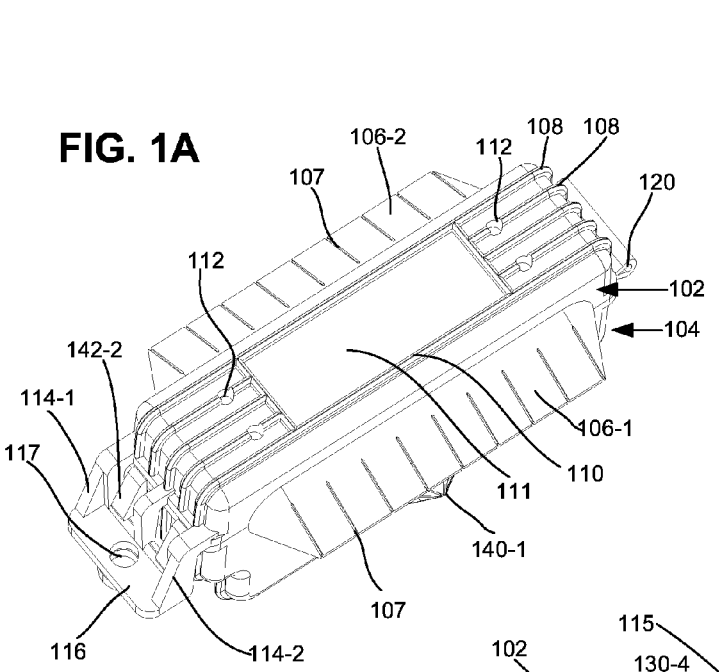
FIG. 1A is an isometric perspective top view of an exemplary insulation piercing connector (IPC) housing in a closed configuration.
Figure 1B:
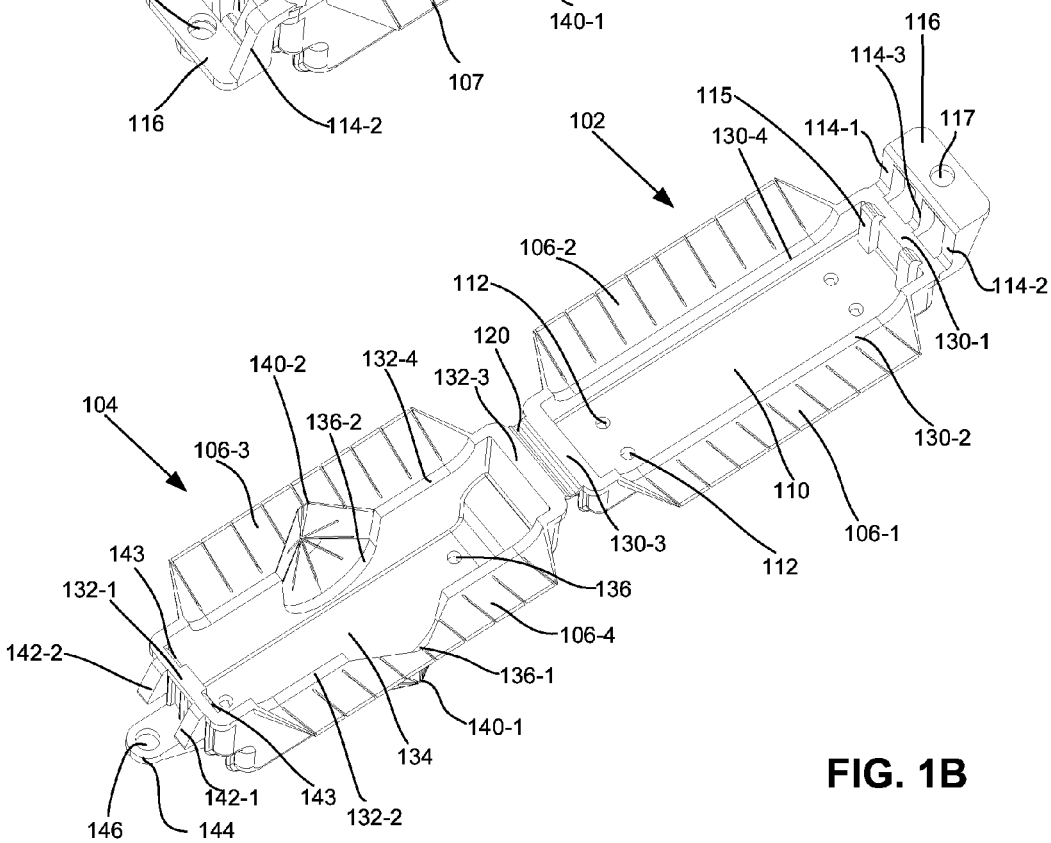
FIG. 1B is an isometric perspective top view of the IPC housing of FIG. 1A in an open configuration.
Figure 1C:
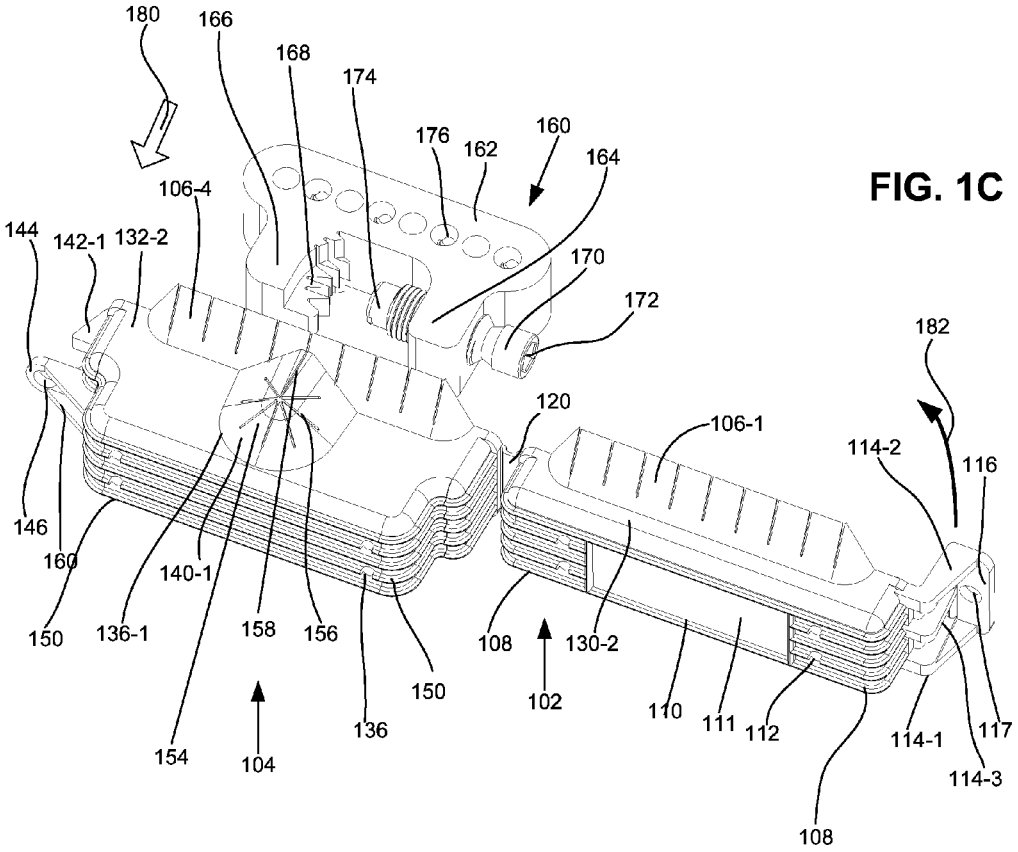
FIG. 1C is an isometric perspective bottom view of the IPC housing of FIG. 1A in the open configuration, with an IPC in a position to be placed inside the IPC housing.
Figure 2A:
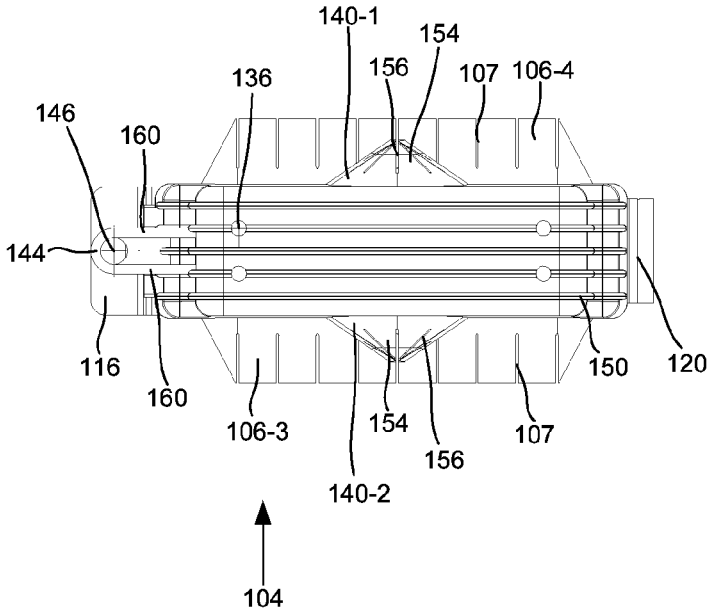
FIGS. 2A and 2B are top and bottom views, respectively, of the IPC housing of FIG. 1A in the closed configuration.
Figure 2B:
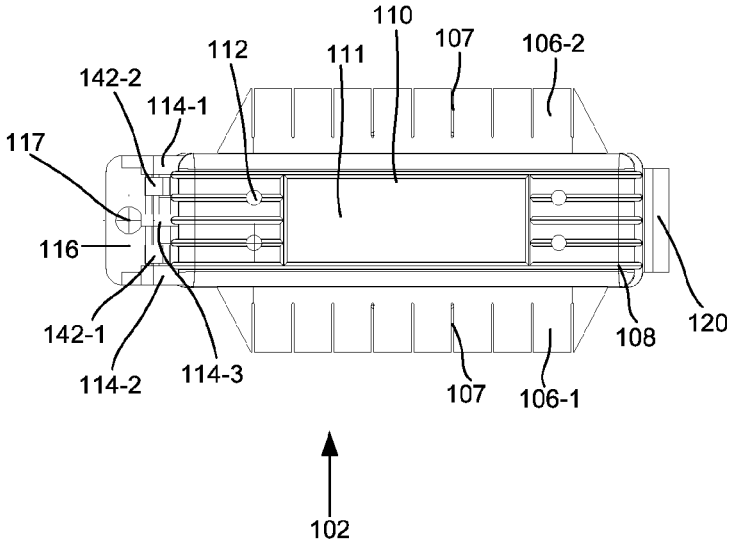

FIG. 1C is an isometric perspective bottom view of IPC housing 100 in the open configuration, with an IPC 160 in a position to be placed inside IPC housing 100. IPC 160 is typically made of a conducting material or metal, such copper alloy, steel, aluminum, etc. As shown, IPC 160 may include a body/trunk 162, lower jaw 164, and upper jaw 166. In some implementations, body/trunk 162, lower jaw 164, and upper jaw 166 may be integrally formed in a U-shape from a single material.

Body/trunk 162 of IPC 160 may include one or more holes 176, into which cables/lines for tapping power may be inserted. Although not visible in FIG. 1C, a top/side of body/trunk 162 may provide for threaded openings into which screws may be inserted and tightened against cables/lines in holes 176. The screws may securely hold the ends of cables/lines in holes 176.

Upper jaw 166 may include teeth or serration 168 on its surface facing lower jaw 164. Depending on the implementation, teeth/serration 168 may be formed of material different from that of body/trunk 162, upper jaw 166 or lower jaw 164, such that teeth/serration 168 provides for higher conductivity than other portions of IPC 160. Lower jaw 164 may include a hole whose axis is in the direction toward upper jaw 166. The hole may accommodate a screw/bolt 170.

When screw/bolt 170 is inserted into the hole and turned (e.g., clockwise), holding end 174 of screw/bolt 170 moves toward teeth/serration 168 of upper jaw 166. If a cable is placed in the spacing between teeth/serration 168 and holding end 174 of screw/bolt 170, and screw/bolt 170 is tightened (e.g., via bolt head 172), holding end 174 may be made to push the cable against teeth/serration 168 with sufficient force for teeth/serration 168 to pierce/penetrate the insulation of the cable, to therefore make an electrical/conductive contact with the conductor within the cable. Once cables are affixed in holes 176 and the spacing between teeth/serration 168 and holding end 174, IPC 160 may be inserted into lower cover 104 in the direction of arrow 180. Upper cover 102 may be closed about hinge 120 in the direction of arrow 180. When IPC 160 is inside IPC housing 100 that is closed (e.g., FIG. 1A), the cables attached to IPC 160 may extend from IPC 160 to the outside of IPC housing 100 through different portions of IPC housing 100, as described below.

Figure 4A:
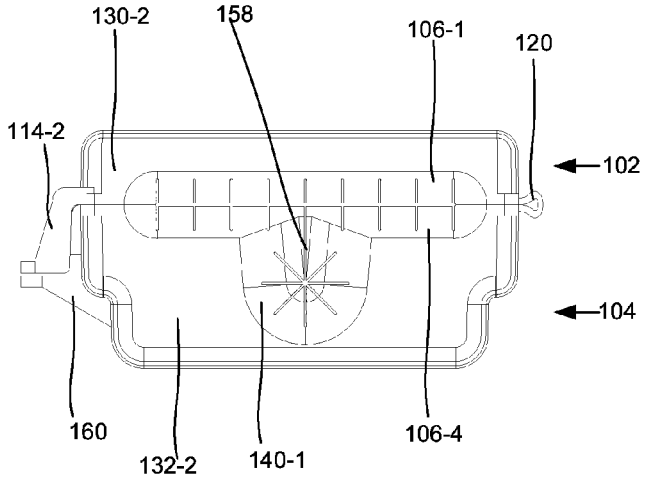
FIGS. 4A, 4B, and 4C are side, rear, and front views, respectively, of the IPC housing of FIG. 1A in the closed configuration.
Figure 4B:
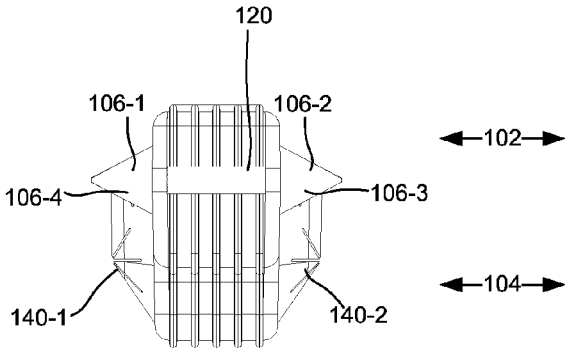
Figure 4C:
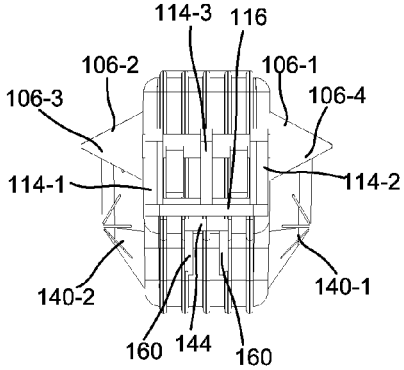
Figure 5A:
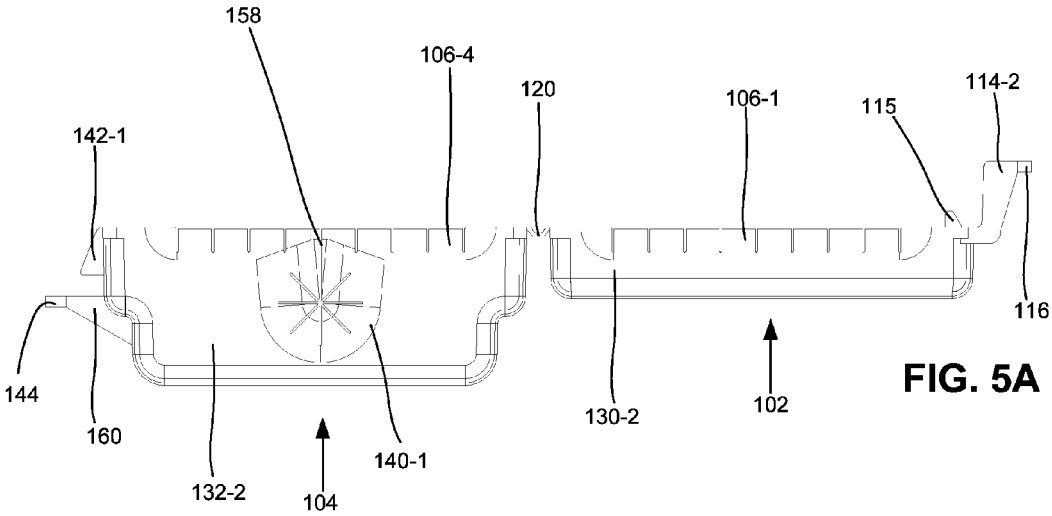
FIGS. 5A, 5B, and 5C are side, rear, and front views, respectively, of the IPC housing of FIG. 1A in the open configuration.
Figure 5B:
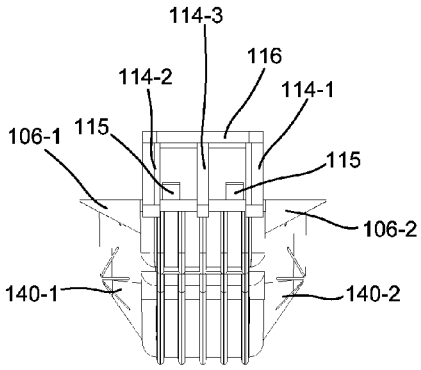
Figure 5C:
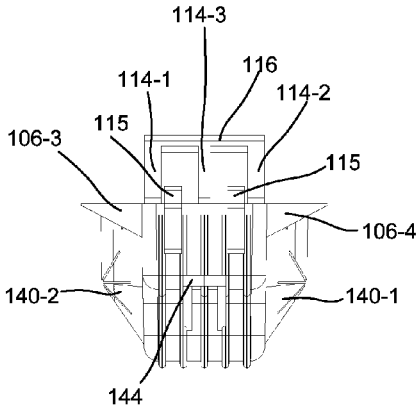

Referring to FIGS. 1A-1C and 3A-3C, upper cover 102 may include front wall 130-1, side wall 130-2, rear wall 130-3, side wall 130-4 (collectively "walls 130"), and a panel 110 that partially enclose/surround a cavity within upper cover 102. As shown, walls 130-1 through 130-4 may be substantially perpendicular to panel 110. Furthermore, each of walls 130-1 through 130-4 may be perpendicularly adjoined to two of the other walls 130. Walls 130-2 and 130-4 include notched portions whose height (measured from panel 110 to its edge) is lower than that of walls 130-1 and 130-3 as shown in FIGS. 1B, 4A, and 5A.

Lower cover 104 may include front wall 132-1, side wall 132-2, rear wall 132-3, side wall 132-4 (collectively walls 132), and a panel 134 that partially enclose/surround a cavity within lower cover 104. As shown in FIG. 1B, walls 132-1 through 132-4 may be perpendicular to panel 134. Furthermore, each of walls 132-1 through 132-4 may be perpendicularly adjoined to two of the other walls 132. Walls 132-2 and 132-4 include notched portions whose height (measured from panel 134 to its edge) is lower than that of walls 132-1 and 132-3, as shown in FIGS. 1B, 4A, and 5A.

In one embodiment, when IPC housing 100 is closed, the top edge surfaces of walls 130-1 and 130-3 are brought to contact the top edge surfaces of walls 132-1 and 132-3, respectively, while the short portions of walls 130-2 and 130-4 and 132-2 and 132-4 provide for two side openings to IPC housing 100. If IPC 160 with cables that are attached to holes 160 of IPC 160 is within IPC housing 100, the cables would extend or project from IPC housing 100 via the side openings/gaps formed by the notched portions of walls 130-2 and 132-2 and 130-4 and 132-4 when IPC housing 100 is closed.

In one implementation, wall 130-2 includes fins 106-1. Each of fins 106-1 is partially separated from other fins 106-1 by slits 107, one of which is labeled in FIG. 1A. Fins 106-1 are attached to wall 130-2 such that fins 106-1, from the portion attached to wall 130-2, are slanted toward the plane at which walls 130 of upper cover 102 and walls 132 of lower cover 104 meet when IPC housing 100 is closed.

Similar to wall 130-2, each of walls 130-4, 132-2, and 132-4 includes fins 106-2, 106-4, and 106-3, respectively. Each of fins 106-2, 106-4, and 106-3 is attached to its respective wall in the manner described above with respect to fins 106-1.

When IPC housing 100 is closed, fins 106-1 of wall 130-2 and fins 106-4 of wall 132-2 cover the opening formed by the notched portions of walls 130-2 and 130-4. If IPC 160 with cables in holes 176 are placed within IPC housing 100, fins 106-1 and 106-4 bend to allow the cables to extend from IPC 160 to the outside of housing 100. Because fins 106-1 and 106-4 cover the opening formed by walls 130-2 and 130-4, to steal power by tapping IPC 160 using wires, the wires must pass through fins 106-1 and 106-4 to reach and contact IPC 160. Hence, fins 106-1 and 106-2 provide for protection against power theft.

Similarly, when IPC housing 100 is closed, fins 106-2 of wall 130-4 and 106-3 of wall 132-4 cover the opening formed by walls 130-4 and 132-4. If IPC 160 with cables in holes 176 are placed within IPC housing 100, fins 106-2 and 106-3 allow the cables to extend from IPC 160 to the outside of IPC housing 100. Because fins 106-2 and 106-3 cover the opening formed by walls 10-4 and 132-4, to steal power by tapping IPC 160 using wires, the wires must pass through fins 106-2 and 106-3 to reach and contact IPC 160.

Because each of fins 106-1 through 106-4 is partially separated from other fins via slits 107, if a cable juts out from IPC 160 through a pair of upper and lower fins, fins that are next to the pair of fins remain shut, still covering portions of the openings (in IPC housing 100) through which other holes 176 of IPC 160 may be accessed.

Fins 106-1 through 106-4 may be constructed to be thinner than walls 130 and 132, so that fins 106-1 through 106-4 are more flexible than walls 130 and 132. In some constructions, fins 106-1 through 106-4 may be tapered to be thinner as they extend from walls 130 and 132. In some implementations, fins 106-1 through 106-4 may be made of the same material as walls 130 and 132 or other portions of IPC housing 100. In other implementations, IPC housing 100 may be made of a different material.

As shown in FIGS. 1B and 1C, wall 130-3 of upper cover 102 and wall 132-1 of lower cover 104 are attached/connected to one another via hinge 120. Although hinge 120 is shown as a plastic, folding type hinge, in other implementations, hinge 120 may include another type of hinge, such as a butt hinge, butterfly hinge, piano hinge, etc. Upper cover 102 and lower cover 104 may swivel relative one another about hinge 120, to open and close IPC housing 100. In a different implementation, IPC housing 100 may exclude hinge 120, and upper cover 102 may be attached lower cover 104 by another component (e.g., a plastic string, wire, etc.). In some implementations, IPC housing 100 may be closed by snap-fitting upper cover 102 and lower cover 104 to one another and securing upper cover 102 and lower cover 104 with screws.

Front wall 130-1 of upper cover 102 may include an upper locking piece 116, which juts away from the exterior side of wall 130-1. Upper locking piece 116 is supported from front wall 130-1 by support members 114-1, 114-2, and 114-3. Support members 114-1, 114-2, and 114-3 may be equally spaced apart from one another and attached to the exterior surface of front wall 130-1. Furthermore, support members 114-1 through 114-3 may extend from the points of attachment, away from the surface of wall 130-1 in the direction perpendicular to panel 110, toward upper locking piece 116.

Similarly, front wall 132-1 of lower cover 104 may include a lower-locking piece 144 and protrusions 142-1 and 142-2. Lower locking piece 144 and protrusions 142-1 and 142-2 extend away from the exterior surface of front wall 132-1. Lower locking piece 144 is positioned under and between protrusions 142-1 and 142-2, between the plane of panel 132 and the flats of the edges of walls 132.

When IPC housing 100 is closed, upper locking piece 116 is placed over front wall 132-1, and comes into contact with lower locking piece 144. Protrusion 142-1 of front wall 132-1 fits into the spacing between support members 114-2 and 114-3, and protrusion 142-2 of front wall 132-1 fits into the spacing between support members 114-1 and 114-3.

Protrusion 142-1 may be shaped like a flat piece of a right triangle, with one edge of the triangle attached to front wall 132-1 (FIG. 5A). Therefore, as upper locking piece 116 is brought toward lower locking piece 144 over protrusion 142-1 (and protrusion 142-2), upper locking piece 116 first contacts the outer edge (i.e., the hypotenuse) of triangular protrusion 142-1. The contact may prevent the upper locking piece 116 from touching lower locking piece 144, until additional force is applied to bring upper cover 102 together with lower cover 104. Upon application of necessary force, upper locking piece 116 may be forcibly slid over protrusions 142 and may snap into a position underneath the base of triangular protrusions 142-1.

When IPC housing 100 is closed, hole 117 in upper locking piece 116 aligns with hole 146 in lower locking piece 144, and provides for the bolt of a lock to pass there-through. When the lock is secured, the lock may prevent upper locking piece 116 and lower locking piece 144 of IPC housing 100 from separating and opening IPC housing 100.

Figure 3A:
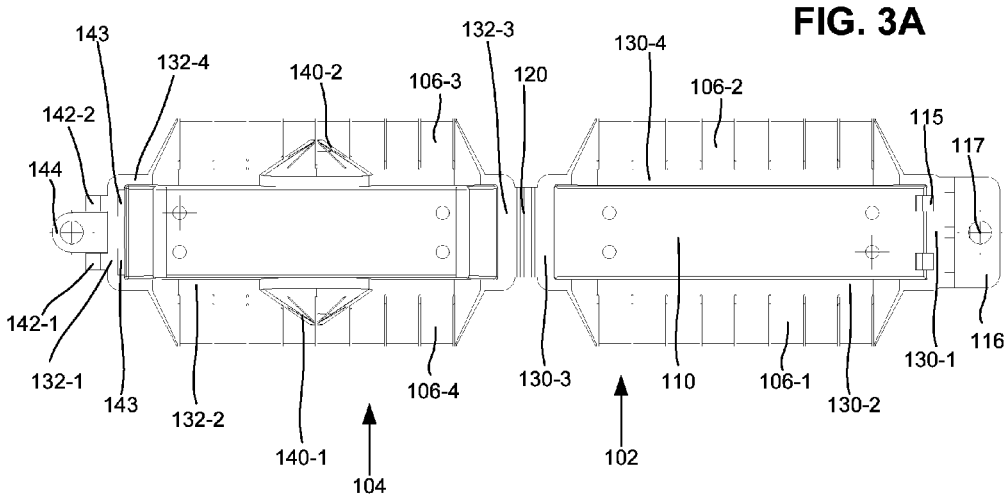
FIGS. 3A and 3B are top and bottom views, respectively, of the IPC housing of FIG. 1A in the open configuration.
Figure 3B:
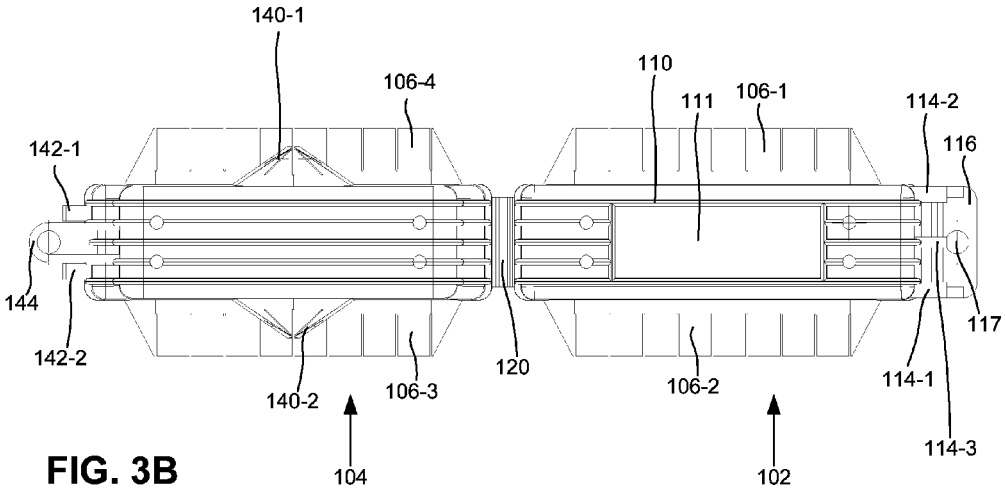

As shown in FIGS. 1B and 3A, upper cover 102 includes two columns 115. The inner surface of front wall 130-1 adjacent to two columns 115, which project from panel 110 to a point above front wall 130-1. When IPC housing 100 is closed, the tips of columns 115 of upper cover 102 fit into corresponding groove/notches 143 on front wall 132-1 of lower cover 104. Columns 115 provide for additional stability in preventing upper cover 102 from sliding laterally against lower cover 104 when IPC housing 100 is closed. In some implementations, upper cover 102 may include barbs in place of columns 115. In such implementations, when IPC housing 100 is closed, the barbs may hook into the notches of lower cover 104, to securely hold upper cover 102 and lower cover 104 together.

Panels 110 and 132 include holes 112 and 136, respectively. Holes 112 and 136 allow moisture or water that sometimes collects inside of IPC housing 100 to leak/dry out and prevent the moisture from causing problems (e.g., rusting, corrosion, etc.). In addition, panels 110 and 132 may include ridges 108 and 150 in the lengthwise directions on exterior surfaces thereof. Ridges 108 and 150 provide for additional strength and rigidity to upper cover 102 and lower cover 104.

Panel 110 includes area 111 that is clear of ridges 108. Depending on the implementation, area 111 may display letters, logos, symbols, pictures, etc.

Walls 132-2 and 132-4 include semi-oval holes 136-1 and 136-2, respectively. Semi-oval hole 136-1 extends from about the center of wall 132-2 to the top edge of wall 132-2. Semi-oval hole 136-2 extends over a corresponding area in wall 132-4. Holes 136-1 and 136-2 permit a cable that is held by teeth/serration 168 of upper jaw 166 and holding end 174 of screw/bolt 170 of IPC 160 to pass through IPC housing 100 while preventing or limiting unauthorized access to IPC 160.

Walls 132-2 and 132-4 include rounded portions 140-1 and 140-2 that cover semi-oval holes 136-1 and 136-2, respectively. As shown in FIG. 1C, rounded portion 140-1 protrude/bulge outwardly from the plane of wall 132-2. Rounded portion 140-1 includes multiple crossing slits 156 that form flaps 154 in rounded portion 140-1. That is, each flap 154 in rounded portion 140-1 is cut or separated from other flaps through slits 156. As shown in FIGS. 1C, 4A and 5A, a central slit 158 extends from the center of rounded portion 154 toward fins 106-4. Rounded portion 140-2 is constructed similarly as rounded portion 140-1.

When a cable is held by upper teeth/serration 168 of upper jaw 166 and holding end 174 of screw 170, and IPC 160 is inserted into lower cover 104 (in the direction of arrow 180), the cable may be substantially perpendicular to the planes of walls 132. As IPC 160 is inserted into lower cover 104, the cable pushes against the middle of fins 106-4 and 106-3. As IPC 160 is pushed further into lower cover 104, fins 106-4 (and fins 106-3) are separated, giving way to central slit 158 of rounded portion 140-1. As IPC 160 is pushed further into lower cover 104, individual flaps 154 of rounded portion 140-1 (and 140-2) are also separated, to accommodate the cable. At this point, each of the individual flaps 154 outwardly extend from the plane of wall 132-2 along the surface of the cable, gripping the cable. Rounded portion 140-2 and corresponding flaps 154 may be constructed similarly as rounded portion 140-1 and its flaps 154 and may operate similarly.

When IPC 160 is inside IPC housing 100 and IPC housing 100 is closed, because flaps 154 protrude outward and away from walls 132-2 and 132-4 and they apply force to the cable held by teeth/serration 168 and holding end 174 associated with IPC 160, accessing IPC 160 through flaps 154 and tapping IPC 160 to steal power may be difficult. In some implementations, to provide flexibility to flaps 154, each of flaps 154 may be constructed such that each flap's thickness is tapered from its base near wall 132-2 (or 132-4) toward its tip. In addition, depending on the implementation, flaps 154 may be made of a material different form that of walls 132.

As described above, IPC housing 100 insulates and/or protects IPC 160 that may be used with a duplex or triplex cable. IPC housing 100 prevents shorts and protects installers. In addition, IPC housing 100 includes upper locking piece 116 and lower locking piece 144 that may be used with a serialized utility lock (or another type of lock) to secure IPC housing 100. Upper locking piece 116, lower locking piece 144 and the lock may prevent unauthorized opening of IPC housing 100, tapping IPC 160 within IPC housing 100, and stealing power from IPC 160.

The foregoing description of implementations provides illustration, but is not intended to be exhaustive or to limit the implementations to the precise form disclosed. Modifications and variations are possible in light of the above teachings or may be acquired from practice of the teachings.

For example, walls 130-2 and 132-2 and walls 130-4 and 132-4 are described above as forming openings for wires that tap IPC 160 within IPC housing 100. In other implementations, walls 132-2 and 132-4 may include holes, similar to holes 136-1 and 136-2, for accommodating wires that tap IPC 160. In such implementations, in place of fins 106-1 through 106-4, walls 132-2 and 132-4 may include a number of portions that are similarly constructed as rounded portions 140-1 and 140-2 (e.g., having a central slit and flaps), to protect IPC 160 against unauthorized access.

Although different implementations have been described above, it is expressly understood that it will be apparent to persons skilled in the relevant art that the implementations may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

No element, act, or instruction used in the present application should be construed as critical or essential to the implementations described herein unless explicitly described as such. Also, as used herein, the article "a" is intended to include one or more items. Further, the phrase "based on" is intended to mean "based, at least in part, on" unless explicitly stated otherwise.

What is claimed is:

1. A housing comprising:

an upper portion, including:

a first front wall including a first locking piece on an exterior surface of the first front wall;

a first panel;

a first side wall and a second side wall facing one another; and a first rear wall facing the first front wall, wherein the first front wall, the first panel, the first side wall, and the second side wall are joined at their edges to form a first cavity; and a lower portion, including:

a second front wall including a second locking piece on an exterior surface of the second front wall;

a second panel;

a third side wall with a first hole;

a fourth side wall with a second hole; and a second rear wall facing the second front wall, wherein the second front wall, the second panel, the third side wall, and the fourth side wall are joined at their edges to form a second cavity, wherein the upper portion and lower portion are attached to one another via a hinge that joins the first rear wall of the upper portion to the second rear wall of the lower portion, wherein when an insulation piercing connector (IPC) with a cable is received into the second cavity, the IPC with the cable is inserted into the lower portion such that the cable enters the housing via the first hole and exits the housing via the second hole, the upper portion and the lower portion are brought into a contact at edges of the walls, and the first locking piece and the second locking piece are secured together via a lock.

2. The housing of claim 1, wherein the second panel includes lengthwise ridges that strengthen the second panel, and the first panel includes lengthwise ridges that strengthen the first panel.

3. The housing of claim 1, wherein the first panel further includes a first exterior surface area for displaying letters or images.

4. The housing of claim 1, wherein the first panel and the second panel include one or more holes through which moisture inside the housing escapes the housing.

5. The housing of claim 1, wherein the third side wall of the lower portion includes a set of flaps that cover the first hole and protrude outwards from the surface of the third side wall, wherein when the IPC is received into the second cavity, the cable enters the housing via the first hole through the flaps.

6. The housing of claim 5, wherein when the IPC is received into the second cavity, each of the flaps is tapered such that the flap is thicker toward the third wall and thinner away from the third wall.

7. The housing of claim 1, wherein when the IPC is received into the second cavity, the third wall and the second wall form an opening through which one or more wires that tap the IPC exit the housing.

8. The housing of claim 7, wherein the third wall and the fourth wall include fins that cover the opening, wherein when the IPC is received into the second cavity, and the one or more wires are attached to the IPC, the one or more wires enter the housing between the fins and through the opening.

9. The housing of claim 8, wherein each of the fins is tapered such that the fin is thicker toward an end, of the fin, attached to the third wall and thinner away from the end.

10. The housing of claim 8, wherein each of the fins is separated from other fins by one slit or two slits, such that each of the fins bends independently of other fins to allow one of the one or more wires to enter the housing between two of the fins without causing others of the fins to expose the opening.

11. The housing of claim 1, wherein the housing comprises thermo plastic polymer.

12. The housing of claim 1, wherein the IPC includes a member and a component for piercing an insulation, of the cable, that covers a conductor within the cable and making a contact with the conductor.

13. The housing of claim 1, wherein the IPC comprises one or more conductive materials.

14. A housing for retaining an insulation piercing connector (IPC), comprising:

an upper housing;

a lower housing including a cavity formed therein; and a hinge coupled to the upper housing and the lower housing to permit movement of the upper housing and the lower housing into open and closed configurations;

wherein, when in the closed configuration, the upper housing is aligned with the lower housing, wherein a second cavity is configured to receive the IPC, and wherein the lower housing includes an aperture formed transversely therethrough for receiving a cable extending from the IPC upon receipt of the IPC into the second cavity.

15. The housing of claim 14, wherein the upper housing and the lower housing include lock elements to secure the upper housing to the lower housing in the closed configuration.

16. The housing of claim 15, wherein the lower housing includes a plurality of resilient portions for permitting cables tapped into the IPC to egress the lower housing.

17. The housing of claim 16, wherein the plurality of resilient portions comprise a plurality of independently moveable resilient fins.

18. The housing of claim 17, wherein the plurality of independently moveable resilient fins are shaped to prevent ingress of cables while facilitating egress of the cables when the housing is in the closed configuration.

19. The housing of claim 16, wherein the upper housing includes a second plurality of resilient portions corresponding to the plurality of resilient portions in the lower housing, such that cables tapped into the IPC egress the lower housing and the upper housing via the resilient portions.

20. An insulation piercing connector (IPC) housing comprising:

an upper portion including a first locking piece on an exterior surface of the upper portion; and the lower portion including a second locking piece on an exterior surface of the lower portion, wherein the upper portion and the lower portion are hinged together to open and close, wherein when the housing is closed, an IPC with a cable is inserted into the lower portion such that the cable enters the housing via a first hole on the lower portion and exits the housing via a second hole in the lower portion;

the upper portion and the lower portion are brought into a contact at edges of walls of the upper portion and the lower portion, and the first locking piece and the second locking piece are prevented from separating via a lock.

* * * * *